US010665982B2

(12) United States Patent
Herbrechtsmeier et al.

(10) Patent No.: US 10,665,982 B2
(45) Date of Patent: May 26, 2020

(54) RETAINING FRAME ASSEMBLY HAVING MAIN FRAME AND SECURING ELEMENT AND FITTING METHOD

(71) Applicant: HARTING Electric GmbH & Co. KG, Espelkamp (DE)

(72) Inventors: Heiko Herbrechtsmeier, Bünde (DE); Heiko Meier, Minden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/318,342

(22) PCT Filed: Jul. 17, 2017

(86) PCT No.: PCT/EP2017/067990
§ 371 (c)(1),
(2) Date: Jan. 16, 2019

(87) PCT Pub. No.: WO2018/015332
PCT Pub. Date: Jan. 25, 2018

(65) Prior Publication Data

US 2019/0252820 A1 Aug. 15, 2019

(30) Foreign Application Priority Data

Jul. 20, 2016 (DE) ..... 10 2016 213 251

(51) Int. Cl.
*H01R 13/518* (2006.01)
*H01R 13/506* (2006.01)
*H01R 43/20* (2006.01)

(52) U.S. Cl.
CPC ..... *H01R 13/518* (2013.01); *H01R 13/506* (2013.01); *H01R 43/20* (2013.01)

(58) Field of Classification Search
CPC ..... H01R 13/518; H01R 13/506; H01R 43/20
(Continued)

(56) References Cited

U.S. PATENT DOCUMENTS 3,160,280 A * 12/1964 Burch ..... H02B 1/052 211/89.01
3,576,520 A * 4/1971 Stauffer ..... H01R 9/26 439/716
(Continued)

FOREIGN PATENT DOCUMENTS

DE 298 12 500 U1 10/1998
DE 10 2013 113 976 A1 6/2015
(Continued)

OTHER PUBLICATIONS

International Search Report and Written Opinion, dated Sep. 20, 2017, for International Application No. PCT/EP2017/067990, 13 pages (with English translation of Search Report).

*Primary Examiner* — Alexander Gilman
(74) *Attorney, Agent, or Firm* — Seed IP Law Group LLP

(57) ABSTRACT

The disclosure relates to the field of holding frames for a plug connector for receiving similar and/or different modules. To provide a way of populating a holding frame with modules even when the holding frame is already installed in a casing, and in a manner that is compatible with known modules, a holding frame arrangement for a plug connector for receiving similar and/or different modules is proposed, comprising a base frame adapted to receive a module and a fixing element adapted for fixing to the base frame such that the base frame and the fixing element fixed to it together define a fixing window for engaging a fixing lug of a received in order to fix the module in place.

10 Claims, 3 Drawing Sheets

(58) Field of Classification Search
USPC ..... 439/540.1
See application file for complete search history.

(56) References Cited

U.S. PATENT DOCUMENTS

| | | | | | |
|---|---|---|---|---|---|
| 4,124,878 | A * | 11/1978 | Ebner | H05K 7/1424 | 361/756 |
| 5,595,507 | A * | 1/1997 | Braun | H01R 4/64 | 439/716 |
| 6,004,162 | A * | 12/1999 | Harting | H01R 13/518 | 439/532 |
| 6,113,414 | A * | 9/2000 | Fukuda | H01R 13/639 | 439/352 |
| 6,773,271 | B2 * | 8/2004 | Falchetti | H01H 85/2045 | 439/701 |
| 7,066,677 | B2 * | 6/2006 | Ruter | H01R 13/516 | 403/231 |
| 8,287,306 | B2 * | 10/2012 | Daugherty | H01R 13/6315 | 439/540.1 |
| 9,192,537 | B2 * | 11/2015 | Schlegel | H01R 13/518 | |
| 9,502,813 | B2 * | 11/2016 | Dugo | H01R 9/2408 | |
| 9,608,374 | B2 * | 3/2017 | Beischer | H01R 13/514 | |
| 10,050,391 | B2 * | 8/2018 | Herbrechtsmeier | H01R 13/506 | |
| 10,128,604 | B2 * | 11/2018 | Li | H01R 13/447 | |
| 10,276,968 | B2 * | 4/2019 | Herbrechtsmeier | H01R 13/506 | |
| 10,283,900 | B2 * | 5/2019 | Herbrechtsmeier | H01R 13/506 | |
| 10,333,244 | B2 * | 6/2019 | Herbrechtsmeier | H01R 13/518 | |
| 2006/0207782 | A1 | 9/2006 | Pearse et al. | | |
| 2007/0155252 | A1 * | 7/2007 | Ferderer | H01R 13/506 | 439/680 |
| 2010/0159728 | A1 * | 6/2010 | Wang | H01R 13/112 | 439/312 |
| 2016/0285194 | A1 | 9/2016 | Herbrechtsmeier | | |
| 2018/0026405 | A1 * | 1/2018 | Schlepp | H01R 13/73 | 439/540.1 |
| 2018/0248298 | A1 * | 8/2018 | Schonfeld | H01R 13/518 | |
| 2018/0277978 | A1 * | 9/2018 | Schonfeld | H01R 13/506 | |

FOREIGN PATENT DOCUMENTS

| | | | |
|---|---|---|---|
| DE | 10 2015 101 433 | B3 | 6/2016 |
| EP | 0 860 906 | B1 | 5/2004 |
| EP | 1 801 927 | B1 | 5/2010 |
| EP | 2 581 991 | A2 | 4/2013 |
| FR | 2 781 092 | A1 | 1/2000 |
| JP | 2002-305829 | A | 10/2002 |
| TW | 201328044 | A1 | 7/2013 |

* cited by examiner

RETAINING FRAME ASSEMBLY HAVING MAIN FRAME AND SECURING ELEMENT AND FITTING METHOD

BACKGROUND

Technical Field

The present disclosure relates to the field of holding frames for modules and in particular of holding frames for a plug connector for receiving similar and/or different modules.

Holding frames are used to accommodate a plurality of similar and/or different modules. These modules may be insulating bodies, for example, which are provided as contact holders for electronic and electrical and possibly also for optical and/or pneumatic contacts. One purpose of such holding frames is ultimately to accommodate the plug connector modules so that they are each held and positioned in a defined and desired manner, the aim being to position and orient the modules in a way that facilitates and indeed makes it possible to mate opposite modules.

Description of the Related Art

Various concepts for realizing holding frames are known from the prior art.

There are some approaches in which the modules are each provided with snap-in elements that are spread outwards on insertion of the module into the holding frame and which then engage with matching contours on or in the holding frame so that the respective module is fixed in place.

Holding frames are known from the prior art, in which a strip with lugs which engages in pockets or similar in the modules through side surfaces of the holding frames is externally attached after the desired modules have been inserted into the holding frame, in order to fix the modules in place inside the holding frame.

There are holding frames in which pockets or perforations for engaging a latching lug or a protrusion on the module are provided in side surfaces, the side surfaces having to be spread apart for insertion of the modules, so as to allow the modules to be positioned with the latching lugs in the correct position.

Such a holding frame for holding plug connector modules and for installation in plug connection casings or for screwing onto wall surfaces is known from document EP 0 860 906 B1, in which the plug connector modules are inserted into the holding frame and holding means on the plug connector modules cooperate with recesses provided on opposite wall parts (side parts) of the holding frame, wherein the recesses in the form of openings which are bounded on all sides are provided in the side parts of the holding frame, wherein the holding frame separates along a line which is parallel to the side parts of the holding frame, and wherein hinges are arranged in fastening ends of the holding frame in such a way that when the holding frame is screwed onto a fastening surface, the frame parts are oriented in such a way that the side parts of the holding frame are oriented at right angles to the fastening surface and the plug connector modules are connected interlockingly to the holding frame by the holding means. In practice, such holding frames are normally made in a die casting process, and more particularly in a zinc die casting process.

Document EP 2 581 991 A1 discloses another kind of holding frame for plug connector modules, comprising two frame halves which can be latched to each other by linear displacement of the one frame half relative to the other frame half in a sliding direction, wherein mutually corresponding latching means are provided on the frame halves and cause the two frame halves to latch into each other in two different latching positions during linear displacement, in which the frame halves are spaced from each other at different distances.

Instead of moving the entire side surfaces of the holding frame, moving only those regions to the side that are in the way of the latching lug during insertion is also known from the prior art.

Document EP 1 801 927 B1 discloses a holding frame consisting of an integral injection-molded plastic part. The holding frame is formed as a circumferential collar and on its mating side has a plurality of wall segments which are separated by slits. A respective pair of opposite wall segments form an insertion region for a plug-in module, the wall segments having window-like apertures for receiving projections integrally molded with the narrow sides of the modules. A guide groove is also provided in each of the wall segments. The guide groove is formed above the apertures by means of an outwardly offset window web which has an insertion bevel on the inner surface. The plug-in modules also have latching arms integrally molded on the narrow sides, which act in the direction of the cable connectors, and which latch into place under the lateral collar wall, so that two independent latching means fix the plug connector module in the holding frame.

In order to specify, in contrast to the teaching of document EP 1 801 927 B1, for example, a structural design for a holding frame which has good heat resistance and high mechanical robustness and which allows protective earthing, also and in particular when installed in a metal plug connector casing, and which also ensures ease of operation, especially when replacing individual modules, document DE 10 2013 113 976 A1 proposes that a base section (preferably die cast and made of zinc or aluminum or an appropriate alloy, for example) for fixing a received module in a plane and a deformation section (preferably a die formed resilient metal sheet) which can adopt an insertion state and a holding state, the insertion state allowing insertion of at least one module in a direction transverse to the plane in the holding frame and a received module being fixed in place in the holding state. The base section and the deformation section are formed at least partly of different materials, in any case.

What the approaches described above have in common is that, when inserting and/or fixing the modules into the respective holding frame, space is needed in the longitudinal direction of the modules that itself goes beyond the length of the modules in that direction, or indeed—as in the case where a strip with lugs is externally attached—that free access to the side surfaces must be provided. In the case of EP 0 860 906 B1 or EP 2 581 991 A1, the extension of the holding frame itself is increased as a whole, whereas in the cases of EP 1 801 927 B1 and DE 10 2013 113 976 A1, the holding frame is widened at least partially when the latching lugs pass the corresponding elastic elements. Furthermore, in the case of EP 0 860 906 B1 or EP 2 581 991 A1, insertion and/or removal requires that the holding frame is not yet fixed or no longer completely fixed in an installed state, for example in a casing.

BRIEF SUMMARY

One aim of embodiments of the present invention is to provide an alternative to known approaches to holding frames for plug connectors, with which disadvantages of the prior art are avoided or at least mitigated, while also achieving at least some of the advantages of the known solutions.

It is therefore desired that a solution be provided which allows a holding frame to be populated with modules even when the holding frame is already installed, for example in a casing, this alternative also being compatible with modules for which holding frames as described in EP 0 860 906 B1, EP 2 581 991 A1, EP 1 801 927 B1 or DE 10 2013 113 976 A1 are designed, namely of the kind which have at least one latching lug or similar, which engage in a pocket or recess when installed.

According to one aspect of the invention, a holding frame arrangement for a plug connector for receiving similar and/or different modules is proposed, namely a holding frame arrangement comprising a base frame adapted to receive a module, and a fixing element adapted for fixing to the base frame such that the base frame and the fixing element fixed to it together define a fixing window for engaging a fixing lug of a received module in order to fix the module in place.

According to another aspect of the invention, a method of populating a holding frame arrangement for a plug connector for receiving similar and/or different modules is proposed, namely a method comprising inserting a module into a base frame of the holding frame arrangement and fixing a fixing element of the holding frame arrangement to the base frame, the base frame and the fixing element fixed thereto together defining a fixing window in which a fixing lug of the inserted module engages, so that the module is fixed in place.

A starting point for embodiments of the present invention is that modules such as those described and shown in EP 0 860 906 B1, EP 2 581 991 A1, EP 1 801 927 B1 or DE 10 2013 113 976 A1 are already used in many applications. Modifying the modules themselves, for example by providing deformable snap-in elements on the modules themselves, would mean that previously used and above all previously procured but not yet installed holding frames would no longer be compatible with such modified modules. Suitably adapted holding frames would then be no longer compatible, in turn, with existing modules that are not modified in such a way. That alone could significantly limit their acceptance, which may make it unattractive for manufacturers and distributors to invest in such a direction.

Part of the background to aspects of the present invention can be found in the following considerations.

It was realized that it is possible to maintain compatibility with known modules by maintaining the principle of receiving latching lugs in a corresponding region in the holding frame, although an alternative to the known approaches of displacing at least the side parts of the holding frame to pass by the latching lugs, and deforming parts of the side parts of the holding frame, can be achieved by giving the holding frame a multi-part design, so that the module is firstly inserted into a first part of the holding frame or holding frame arrangement, after which the module itself is fixed in place by adding or fixing in place a second part of the holding frame arrangement. Instead of a part of the holding frame being laterally spread, the holding frame is given a multi-part design such that, to insert a module, the part of the holding frame that would otherwise be in the way of the latching lug or latching lugs of the module is removed (or is not mounted in the first place).

In one advantageous embodiment of one aspect of the invention, the fixing element has a first and a second fixing section which are each designed to define a fixing window with the base frame on opposite sides of said base frame when they are fixed thereto.

The inserted module can be fixed in place to a certain degree simply by providing a fixing section, although it is advantageous if, in the case of module having a fixing lug on two sides, a fixing section is also provided on both sides, which encloses the fixing lug together with the base frame in a fixing window formed by the two elements.

In a particularly advantageous variant of the above embodiment, the fixing element also has a connecting section which connects the first and the second opposite fixing sections to each other, the fixing element also surrounding at least part of a received module in a frame-like manner.

Providing a connecting section which connects two opposite fixing sections to each other allows simplified handling, to begin with. If, in addition, the fixing lugs of the module are designed differently on opposite sides, for example to ensure that the module has a defined orientation, and this is also reflected in the fixing sections, the defined combination of fixing sections via the connecting section facilitates installation, in that a matching pair of fixing sections is provided so that mismatches are prevented better. When the fixing element has a frame-like shape, owing to the fixing sections and the connecting section, that shape can be used to further improve the positioning and orientation of an installed module by having the frame rest against a contour of the module, thus aligning it.

In one advantageous embodiment of one aspect of the invention, the base frame and the fixing element are designed to fix in place with a form fit.

Even if a material connection (e.g., by gluing or welding) and/or a force-fit connection (e.g., by a friction fit when wedging something in place) are likewise possible, fixing with a form fit is advantageous insofar that no additional steps (such as gluing or welding) are needed and also because better uniformity of fixing is achieved (if different forces are set when forming a force-fit connection, there are also differences in the reliability of such fixing). When the form fit is appropriately designed, it can also be released again easily, which means that a module can also be removed again after it has been fixed in place.

In one particularly advantageous variant of the above embodiment, the fixing element has at least one fixing arm with an engagement hook for engaging an undercut or a recess in the base frame.

The mobility of the fixing arm may apply to the fixing arm as a whole, so that the fixing arm is moved within itself (e.g., by bending it) or as a whole (e.g., by pivoting it) during the process of fixing the fixing element. It is likewise possible that the engagement hook itself has mobility (e.g., by deforming or compressing it).

Alternatively or additionally to this variant, mobility can also be provided in the region of the base frame. However, greater manufacturing effort and expense could then be expected, compared, for example, to making the base frame of zinc, aluminum or appropriate alloys (e.g., by die casting).

Whereas the base frame according to some embodiments of the invention is made by die casting and of zinc, aluminum or an appropriate alloy for reasons relating to temperature resistance and to provide electrical contact (protective earth (PE) contact), the fixing element may advantageously be made of a plastic that is sufficiently elastic for latching purposes. Since the fixing element absorbs mechanical forces, primarily or exclusively, and is meant to have certain elasticity (which can also be influenced in the design process), it can be made of any material suitable for that purpose, including metal (e.g., sheet metal) and plastic.

The above variant may also be embodied advantageously in such a way that the movable fixing arm is designed for moving the engagement hook parallel to a plane defined by the fixing window.

If the motion of the fixing arm (analogous to that of a movably designed base frame) is in the direction of the fixing window, i.e., parallel to the plane of the side surfaces of the resultant holding frame, there is no increase in the width of the combination of holding frame (arrangement) and modules when inserting and fixing the module(s) (the width direction is generally the longitudinal direction of the modules), thus obviating the need in such a case for any free space in addition to the holding frame, when populating the holding frame or the base frame of the holding frame arrangement with modules when it is in the installed state. This allows modules to also be mounted from the connection side when the base frame has already been attached in a mounting cut-out (e.g., of a casing) (generally by a screw connection) that provides (only) a minimal width (e.g., a minimum of 34.5 mm in accordance with EN 175301-801: 2006).

The above variant may also be embodied advantageously, alternatively or additionally in such a way that the movable fixing arm is designed for moving the engagement hook transversely to a plane defined by the fixing window, wherein the engagement hook and the region of the base frame past which the engagement hook is moved when fixing it in place are preferably designed so that the fixing arm does not project beyond a side surface of the base frame during said movement.

If the module in the inserted state then rests substantially against the inner side (or inner sides) of the base frame, this results in a region, due to a depth of the fixing lug (i.e., the amount by which the fixing lug projects from the module), within which the engagement hook can be guided past a part of the base frame without the fixing arm protruding relative to an outer side of the base frame, which means that, here also, a desired width for the holding frame is not exceeded in any state.

The layout can be designed in different ways. It is not necessary that the fixing arm, in combination with the section of the base frame behind which the engagement hook engages, have a width equal to the amount by which the fixing lug protrudes in relation to the module, so that this reduced width does not exceed the depth of the fixing lug even when the engagement hook is being guided past the base frame section. The maximum width of the base frame section and the engagement hook, in combination, would not be greater in that case than the amount by which the fixing lug protrudes.

It is also possible for the engagement hook and/or the relevant base frame section to be elastically deformable (e.g., by suitably shaping them for compressibility or flexibility), so as to prevent the fixing element from temporarily protruding relative to the base frame.

It should be noted in this connection that the fixing arm may be provided in such a way that it is inserted between the relevant base frame section and the inserted module, in which case only limited space is available for movement of the fixing arm, due to the relative positions of the base frame and the module.

The above embodiment and its variants may also be advantageously provided with a flexure joint which holds the fixing arm, the fixing element also having a lever section for pivoting the fixing arm about the flexure joint.

Providing such a flexure joint, e.g., in the form of a region with a smaller material thickness, does not necessarily have to mean that this is the only form of mobility that the fixing arm possesses, as the fixing arm and/or the engagement hook itself may also be elastically deformable, for example.

Alternatively or additionally to the above variant of the embodiment, in which the base frame and the fixing element are fixed in place by a form fit, the fixing element and the base frame may be so designed as to provide a plug/slide connection and/or a plug/pivot connection to each other.

A plug/slide or a plug/pivot connection is provided by a connection similar to a bayonet catch, in which the base frame and the fixing element are successively guided relative to each other in two directions to produce a form-fit connection.

Features of advantageous embodiments of the invention are defined in the claims, and a person skilled in the art can also find other advantageous features, embodiments and variants of the invention in the above description and the discussion below.

BRIEF DESCRIPTION OF THE SEVERAL VIEWS OF THE DRAWINGS

In the following, the present invention shall be illustrated and described with reference to the embodiments shown in the Figures.

In the enclosed drawings and in the associated descriptions of said drawings, corresponding or related elements are given corresponding or similar reference signs, where expedient, even when they are to be found in different embodiments.

DETAILED DESCRIPTION

Figure 1:
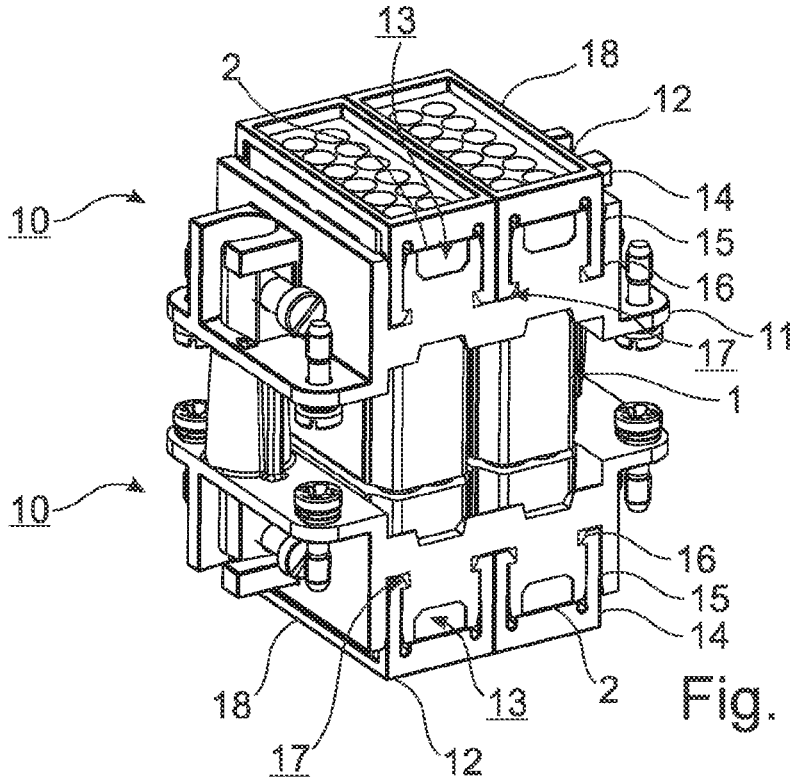
FIG. 1 shows a schematic view illustrating a first embodiment of a holding frame arrangement according to the invention.

FIG. 1 shows a schematic view illustrating a first embodiment of a holding frame arrangement 10 according to the invention.

FIG. 1 shows two holding frame arrangements 10, each containing modules 1.

Each holding frame arrangement 10 comprises a base frame 11 and two fixing elements 12, each forming, in combination with base frame 11, fixing windows 13 in which fixing lugs 2 of modules 1 are received.

Fixing elements 12 each have two fixing sections 14, each of which has two fixing arms 15 which extend in the plug-in direction of the modules 1 and which each have at one end an engagement hook 16 which engages an undercut 17 in the respective base frame 11, in the assembled state shown in FIG. 1.

Fixing sections 14 are also connected to connecting sections 18, so fixing elements 12 each surround a module 1 in the shape of a frame.

In a known manner, base frames 11 each have fixing elements and other functional elements of a holding frame arrangement, such as a PE contact, for example. As these elements match the respective counterparts of conventional holding frames, no further explanation is necessary here, and this applies accordingly to the other embodiments discussed in the following.

In the embodiment of FIG. 1, a fixing element 12 designed as a separate fixing frame is used to fix each module 1 in place. Arms 15 integrally formed on fixing element 12 and having an engagement hook 16 engage in corresponding pockets 17 on base frame 11, which can also be referred to as a module carrier. Fixing elements 12 can be adapted optimally to the respective module 1 to ensure that modules 1 are optimally fixed in place.

The direction of movement of fixing arms 15 is selected in such a way, namely parallel to the plane of fixing window 13, that the width of base frame 11 (equal the length of the end faces) is not exceeded during assembly. This has the advantage that modules 1 can also be mounted from the connection side when base frame 11 has already been screwed into a mounting cut-out of minimum width (e.g., 34.5 mm).

Figure 2:
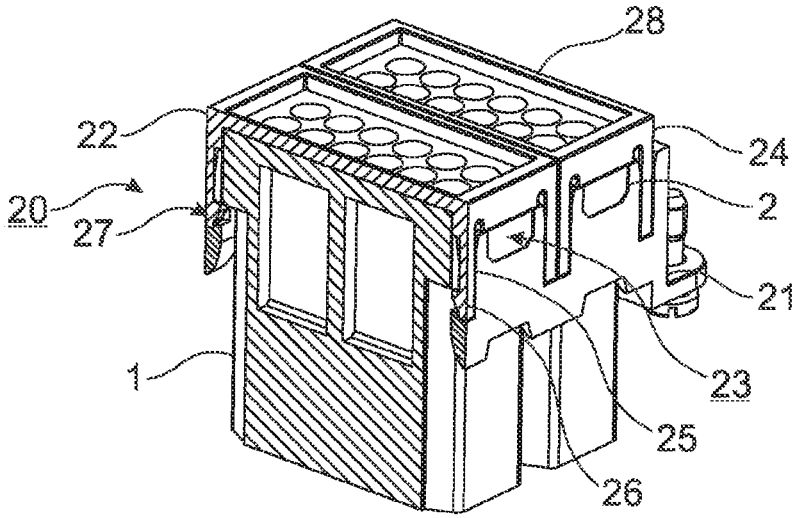
FIG. 2 shows a schematic view illustrating a second embodiment of a holding frame arrangement according to the invention.

FIG. 2 shows a schematic view illustrating a second embodiment of a holding frame arrangement according to the invention.

All that is shown in the view shown in FIG. 2 is a holding frame arrangement 20 with modules 1, the view also showing a partial cross-section through the holding frame arrangement 20 and a module 1.

Similar to the embodiment shown in FIG. 1, holding frame arrangement 20 comprises a base frame 21 and, for each module 1 accommodated, a fixing element 22 which defines, in combination with base frame 21, fixing windows 23 on opposite sites for receiving the fixing lugs 2 of the respective module 1.

Unlike the embodiment shown in FIG. 1, in which the fixing arms are designed for movement in the plane defined by fixing window 13, fixing arms 25 of fixing sections 24 of fixing elements 22 are designed for movement in the longitudinal direction of modules 1, with an engagement hook 26 which engages in a recess 27 of base frame 21 being provided at the end of each fixing arm 25.

Similar to the embodiment shown in FIG. 1, fixing sections 24 of fixing elements 22 are connected to each other by connecting sections 28, such that a frame is formed around each module 1 by the respective fixing element 22.

In comparison with the embodiment illustrated in FIG. 1, the direction of movement of fixing arms 25 is rotated by 90° about the vertical axis of the arrangement. In the embodiment shown in FIG. 2, the width of the base frame is exceeded, due to the shared width of engagement hook 26 and the region of the base frame above recess 27, when fixing element 22 is being fixed in place, although this can be avoided with a suitable layout of the engagement hook and the surroundings of the recess.

Figure 3:
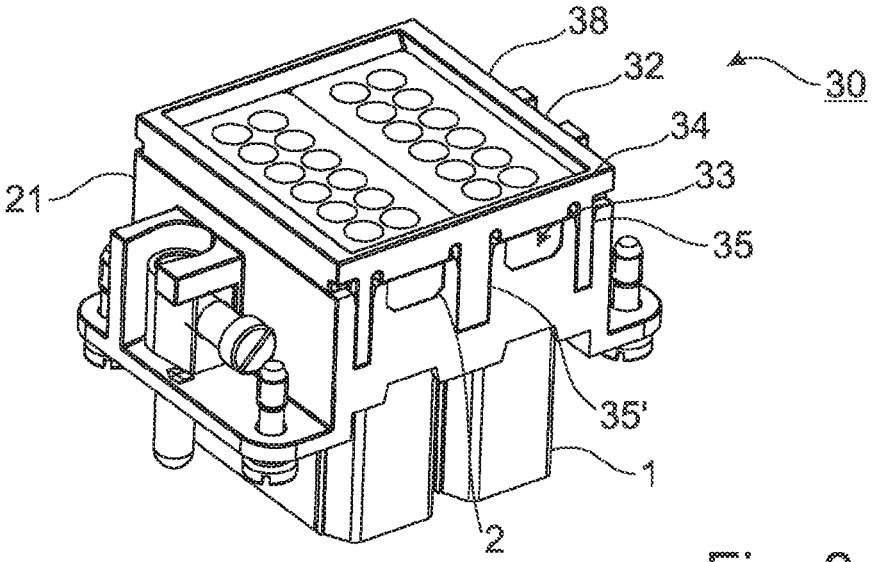
FIG. 3 shows a schematic view illustrating a third embodiment of a holding frame arrangement according to the invention.

FIG. 3 shows a schematic view illustrating a third embodiment of a holding frame arrangement 30 according to the invention. Holding frame arrangement 30 corresponds in large measure to the holding frame arrangement 20 discussed with reference to FIG. 2.

Unlike the embodiment illustrated in FIG. 2, in the case of the embodiment shown in FIG. 3 there is only one common fixing element 32 for two modules, so in addition to fixing arm 35, fixing element 32 has another fixing arm 35' on either side, corresponding to a combination of two adjacent fixing arms 25 in FIG. 2. As can be seen in FIG. 3, fixing element 32 forms two fixing windows 33 on each side of base frame 21, which in this case is identical to base frame 21 in FIG. 2.

Fixing lugs 2 of modules 1 are each received in fixing windows 33.

The fixing sections 34, which are extended in length in comparison with FIG. 2, are connected by two connecting sections 38, such that fixing element 32 forms a frame around the two provided modules 1.

Figure 4:
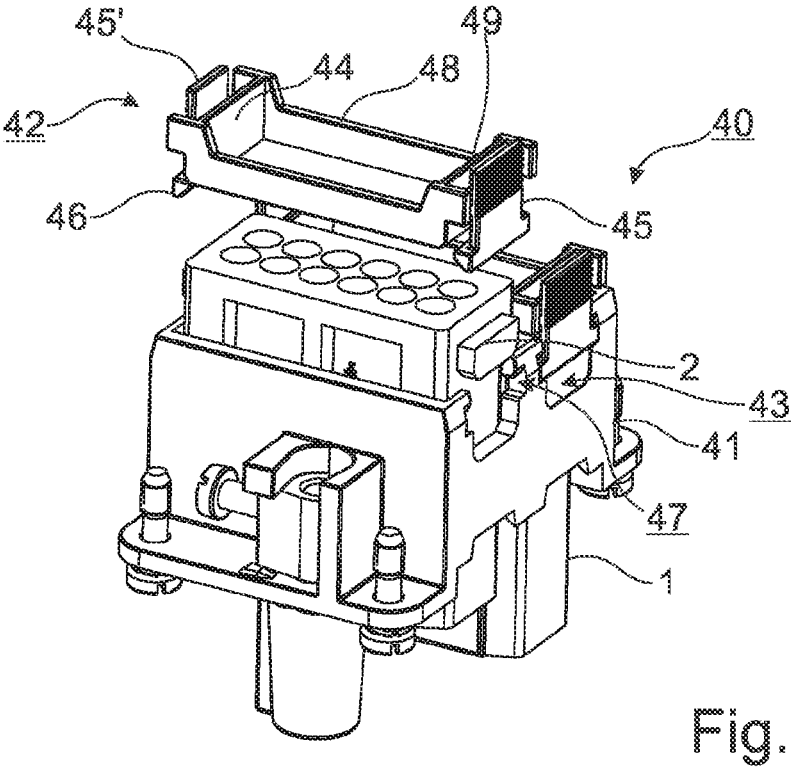
FIG. 4 shows a schematic view illustrating a fourth embodiment of a holding frame arrangement according to the invention.

FIG. 4 shows a schematic view illustrating a fourth embodiment of a holding frame arrangement 40 according to the invention.

As in the embodiments described above, holding frame arrangement 40 comprises a base frame 41 and a number of fixing elements 42 corresponding to the number of modules 1 provided. Each fixing element 42 cooperates with base frame 41 to form two fixing windows 43, which are provided to receive the fixing lugs 2 of a module 1.

In this embodiment, fixing elements 42 comprise a fixing arm 45 having a lever section 45' which is connected via a flexure joint 49 to the rest of fixing element 42, with fixing element 42 having a total of two fixing sections 44, of which fixing arm 45 with its lever section 45' forms a part and which are connected to each other via two connecting sections 48. At the ends of fixing arms 45, engagement hooks 46 are provided which engage in recesses 47 in base frame 41 when fixing element 42 is attached to base frame 41, with the respective fixing lug 2 of module 1 then being docked between fixing section 44 and base frame 41.

The embodiment shown in FIG. 4 is similar to the embodiment shown in FIG. 2. However, disassembly is improved in the former case by lever section 45'.

Figure 5:
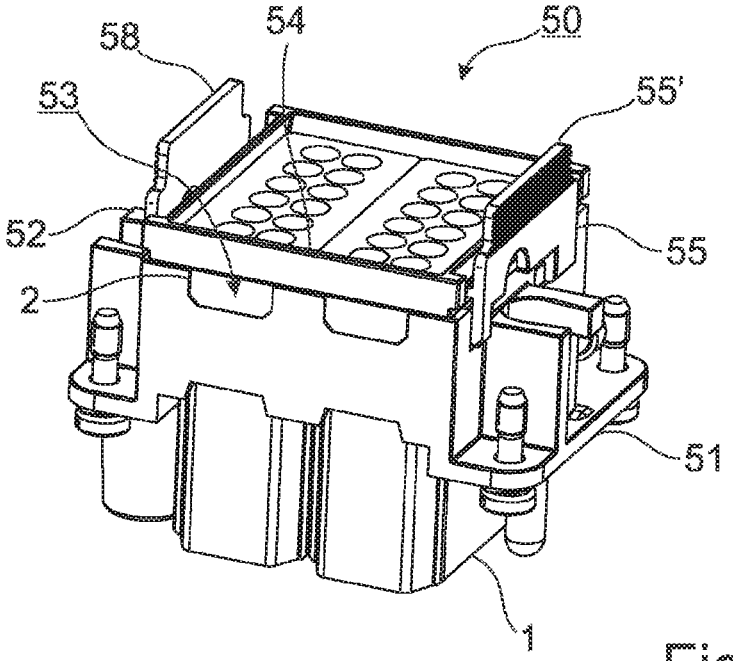
FIG. 5 shows a schematic view illustrating a fifth embodiment of a holding frame arrangement according to the invention.

FIG. 5 shows a schematic view illustrating a fifth embodiment of a holding frame arrangement 50 according to the invention.

Whereas in the embodiments illustrated in FIGS. 1 to 4, the fixing arms are each provided on the longitudinal sides of the holding frame arrangement (i.e., on the transverse sides of module 1), in the case of holding frame arrangement 50, which is illustrated in FIG. 5, a connecting section 58 which connects fixing sections 54 of holding frame arrangement 50 is provided at the end faces of base frame 51, and a fixing arm 55 with a respective lever section 55' is provided on each connecting section 58. In the view shown in FIG. 5, the engagement hook of the fixing arms and the respective recesses of base frame 51 are not shown (as they are hidden from view).

Fixing sections 54, together with base frame 51, define respective fixing windows 53, in which fixing lugs 2 of modules 1 are received.

Figure 6:
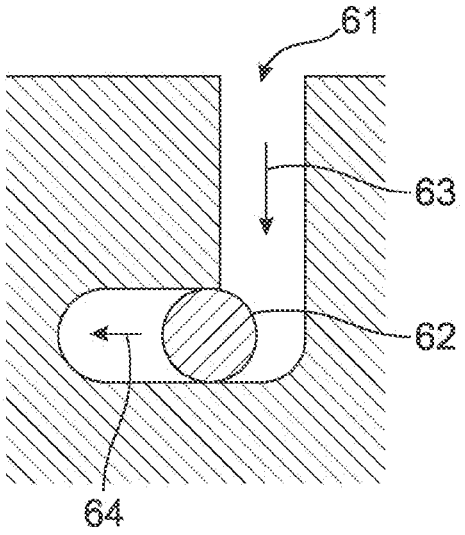
FIG. 6 shows a schematic view illustrating a plug/slide connection.

FIG. 6 shows a schematic view illustrating a plug/slide connection.

The plug/slide connection comprises a guide 61 which cooperates with a peg 62, peg 62 being initially inserted into guide 61 in plug-in direction 63 and then moved in sliding direction 64 extending transversely to plug-in direction 63, thus preventing peg 62 from being pulled out of this connection in the direction of plug-in direction 63.

Figure 7:
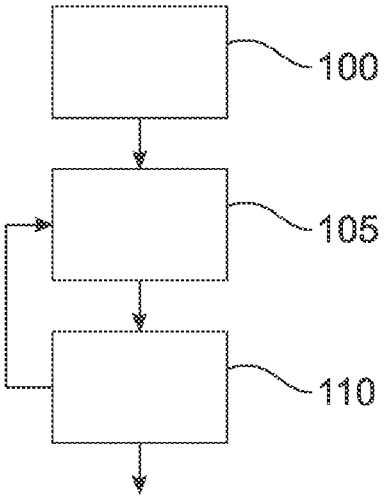
FIG. 7 shows a schematic flow diagram of an embodiment of a method for populating a holding frame arrangement according to the invention.

FIG. 7 shows a schematic flow diagram of an embodiment of a method for populating a holding frame arrangement according to the invention.

In step 100, a base frame of the holding frame arrangement is mounted at the desired location, after which a module is inserted into the base frame in step 105. This is followed by a fixing element of the holding frame arrangement being fixed to the base frame, the base frame and the fixing element fixed thereto together defining a fixing window which surrounds a fixing lug of the inserted module, with the result that, by fixing the fixing element in place, the module is also fixed in place in the holding frame arrangement, between the base frame and the fixing element. Steps 105 and 110 can be repeated until such time as the base frame or holding frame arrangement is completely filled with modules.

Holding frame arrangements for two modules are discussed in the cases of the illustrated embodiments, but the invention is not limited to such arrangements. It is possible for the holding frame arrangement according to embodiments of the invention to be designed for only one module, or for three or more modules. When, in the embodiments, two modules are to be jointly fixed in place by a fixing element, it should be noted that it is also possible, within the scope of the holding frame arrangement according to embodiments of the invention, for more than two modules to be fixed in place by one fixing element. In a holding frame arrangement according to embodiments of the invention, it is possible for fixing elements to be provided for a different number of modules. In a suitable arrangement, it is also possible for two fixing elements to jointly fix a further module in place, in addition to the module(s) that are actually fixed in place by the respective fixing element, the fixing elements each having an additional fixing section and the additional fixing sections jointly defining, in combination with the base frame, a fixing window in which a fixing lug of a module can be received.

Even if different aspects or features of the invention are shown in combination in the Figures, it is clear to a person skilled in the art, unless otherwise specified, that the combinations shown and discussed are not the only ones possible. More particularly, it is possible to swap corresponding units or groups of features from different embodiments.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame arrangement for a plug connector for receiving modules in a plug-in direction, the holding frame arrangement comprising:

a base frame adapted to receive a module having a fixing lug; and a fixing element adapted for removably fixing to the base frame such that the base frame and the fixing element removably fixed to the base frame together define a fixing window for engaging the fixing lug of the module in order to fix the module in place, wherein the base frame includes a lug receiving recess that defines a lower portion of the fixing window and is open-ended to receive the fixing lug in the plug-in direction, and wherein the fixing element is adapted to fix the module in place by removably fixing to the base frame after the fixing lug is received in the open-ended lug receiving recess of the base frame.

2. The holding frame arrangement according to claim 1, wherein the fixing element has a first and a second fixing section which are each designed to define a respective fixing window with the base frame on opposite sides of said base frame when the first and second fixing sections are fixed thereto to receive a respective one of opposing fixing lugs of the module.

3. The holding frame arrangement according to claim 2, wherein the fixing element also has a connecting section which connects the first and the second opposite fixing sections to each other, wherein the fixing element also surrounds at least part of the module in a frame-like manner.

4. The holding frame arrangement according to claim 1, wherein the base frame and the fixing element are designed to fix in place with a form fit.

5. The holding frame arrangement according to claim 4, wherein the fixing element has at least one movable fixing arm with an engagement hook for engaging an undercut or a recess in the base frame.

6. The holding frame arrangement according to claim 5, wherein the movable fixing arm is designed for moving the engagement hook parallel to a plane defined by the fixing window.

7. The holding frame arrangement according to claim 5, wherein the movable fixing arm is designed for moving the engagement hook transversely to a plane defined by the fixing window, wherein the engagement hook and a region of the base frame past which the engagement hook is moved when fixing the fixing element in place are designed so that the movable fixing arm does not project beyond a side surface of the base frame during said movement.

8. The holding frame arrangement according to claim 5, comprising a flexure joint which holds the movable fixing arm, wherein the fixing element also has a lever section for pivoting the movable fixing arm about the flexure joint.

9. The holding frame arrangement according to claim 4, wherein the fixing element and the base frame are adapted for a plug/slide connection and/or a plug/pivot connection to each other.

10. A method of populating a holding frame arrangement for a plug connector, said method comprising:

inserting a module into a base frame of the holding frame arrangement in a plug-in direction such that a fixing lug of the module is received in an open-ended lug receiving recess of the base frame; and thereafter, removably fixing a fixing element of the holding frame arrangement to the base frame such that the open-ended lug receiving recess of the base frame and the fixing element removably fixed thereto together define a fixing window in which the fixing lug of the module engages, so that the module is fixed in place until the fixing element is removed from the base frame.

* * * * *